US008376775B2

(12) United States Patent
Rinehardt

(10) Patent No.: US 8,376,775 B2
(45) Date of Patent: Feb. 19, 2013

(54) SAFETY JUMPER CABLES

(76) Inventor: Steven M Rinehardt, Devils Lake, ND (US)

( * ) Notice: Subject to any disclaimer, the term of this patent is extended or adjusted under 35 U.S.C. 154(b) by 36 days.

(21) Appl. No.: 13/048,187

(22) Filed: Mar. 15, 2011

(65) Prior Publication Data

US 2011/0230081 A1 Sep. 22, 2011

Related U.S. Application Data

(60) Provisional application No. 61/314,655, filed on Mar. 17, 2010.

(51) Int. Cl.
*H01R 3/00* (2006.01)

(52) U.S. Cl. ..... 439/490

(58) Field of Classification Search ..... 439/490, 439/504, 503, 759; 324/379, 393; 320/105
See application file for complete search history.

(56) References Cited

U.S. PATENT DOCUMENTS

| | | | | |
|---|---|---|---|---|
| 4,272,142 | A | 6/1981 | Zapf | |
| 4,349,774 | A | 9/1982 | Farque | |
| 4,386,818 | A | 6/1983 | Millhimes et al. | |
| 4,420,212 | A * | 12/1983 | Wright | 439/490 |
| 4,527,111 | A | 7/1985 | Branham | |
| 4,840,583 | A | 6/1989 | Moore | |
| 4,897,044 | A * | 1/1990 | Rood | 439/504 |
| 4,938,712 | A | 7/1990 | Black | |
| 4,969,834 | A | 11/1990 | Johnson | |
| 5,230,637 | A | 7/1993 | Weber | |
| 5,833,493 | A | 11/1998 | Hung | |
| 6,921,286 | B1 * | 7/2005 | Fernandez | 439/503 |
| 2006/0145655 | A1 | 7/2006 | Sheng | |

FOREIGN PATENT DOCUMENTS

| | | |
|---|---|---|
| CA | 2007666 | 11/1990 |
| CA | 2019092 | 2/1991 |
| CA | 2432421 | 12/2004 |
| DE | 202005005238 | 6/2005 |
| TW | 1238556 | 8/2005 |

* cited by examiner

*Primary Examiner* — Alexander Gilman
(74) *Attorney, Agent, or Firm* — James Ray & Assoc

(57) ABSTRACT

Polarity indicating apparatus for a battery jumper cable assembly includes a first wire having a first end thereof secured in electrical connection directly to a negative battery terminal clamp and having a second end thereof disposed within a positive battery terminal clamp. A second wire has a first end thereof secured in electrical connection directly to a cable-less handle portion of the positive battery terminal clamp. A light source is positioned in close proximity to a free end of the cable-less handle portion of the positive battery terminal clamp and is secured in electrical connection directly to opposite ends of each of the first and second wires. The light source is operable to emit light only when the positive battery terminal clamp is connected to a positive terminal of a battery and when the negative battery terminal clamp is connected to a negative terminal of a battery.

11 Claims, 1 Drawing Sheet

SAFETY JUMPER CABLES

CROSS-REFERENCE TO RELATED APPLICATIONS

This application is related to and claims priority from Provisional Patent Application Ser. No. 61/314,655 filed on Mar. 17, 2010.

FIELD OF THE INVENTION

The present invention relates, in general, to battery jumper cable assemblies, and, more particularly, the instant invention relates to a battery jumper cable assembly having a polarity indicating apparatus mounted at each pair of battery terminal clamps, and yet more particularly, the invention relates to a method of verifying correct attachment of a battery jumper cable assembly to a pair of direct current batteries by using the a polarity indicating apparatus.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND

As is generally known, many individuals are troubled with properly connecting battery jumper cable assembly to a pair of batteries for the purpose of charging a discharged battery from a source or charged battery. Even though, the positive clamps are identified with a red color and negative clamps are identified with a black color, particular problems are experienced with knowing which color clamp is to connect to either positive or negative battery terminal. While efforts have been made prior to conception and design of the instant invention to alleviate such problems, there is a continuing need for a simple and economical apparatus to verify correct polarity connection while using battery jumper cable assembly.

OBJECTS OF THE INVENTION

It is, therefore, one of the primary objects of the present invention to provide an apparatus for charging a battery that is perfectly safe to use.

Another object of the present invention to provide a battery jumper cable assembly that incorporate an LED light that illuminates only when the jumper cable assembly is connected correctly.

Still another object of the present invention to provide a method of attaching a battery jumper cable assembly that is fool proof.

In addition to the various objects and advantages of the invention which have been described in some specific detail above it should be noted that various other objects and advantages of the present invention will become more readily apparent to those persons who are skilled in the relevant art from the following more detailed description, particularly when such description is taken in conjunction with the appended claims.

SUMMARY OF THE INVENTION

The invention provides a polarity indicating apparatus for a battery jumper cable assembly. The polarity indicating apparatus includes a first wire having a first end thereof secured in electrical connection directly to a negative battery terminal clamp and having a second end thereof disposed within a positive battery terminal clamp. There is also a second wire that has a first end thereof secured in electrical connection directly to a cable-less handle portion of the positive battery terminal clamp. A light source is positioned in close proximity to a free end of the cable-less handle portion of the positive battery terminal clamp and is secured in electrical connection directly to opposite ends of each of the first and second wires. The light source is operable to emit light only when the positive battery terminal clamp is connected to a positive terminal of a battery and when the negative battery terminal clamp is connected to a negative terminal of a battery.

The invention also provides a method of verifying, with a polarity indicating apparatus a correct attachment of a battery jumper cable assembly to a pair of direct current batteries, one of the pair of batteries is a source battery. The method includes the step of attaching the polarity indicating apparatus to each end of the battery jumper cable assembly. Then, connecting terminal clamps at one end of the battery jumper cable assembly to respective terminals of the source battery. Next, verifying with the apparatus correct attachment of the jumper cable assembly. Then, disconnecting positive or negative terminal clamp from the source battery. Next, connecting terminal clamps of an opposed end of the battery jumper cable assembly to respective terminals of another one of the pair of batteries. Finally, verifying with the apparatus correct attachment of the opposed end of the battery jumper cable assembly.

DETAILED DESCRIPTION OF DRAWINGS ATTACHED

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

BRIEF DESCRIPTION OF THE VARIOUS EMBODIMENTS OF THE INVENTION

Figure 1:
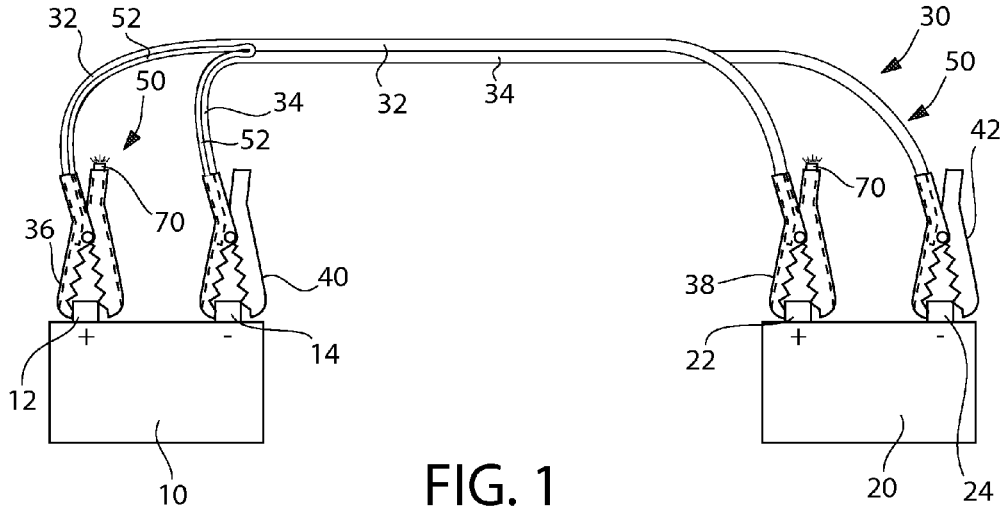
FIG. 1 is a planar elevation view of the apparatus showing a battery jumper cable assembly with an light source on the red or positive cable.
Figure 2:
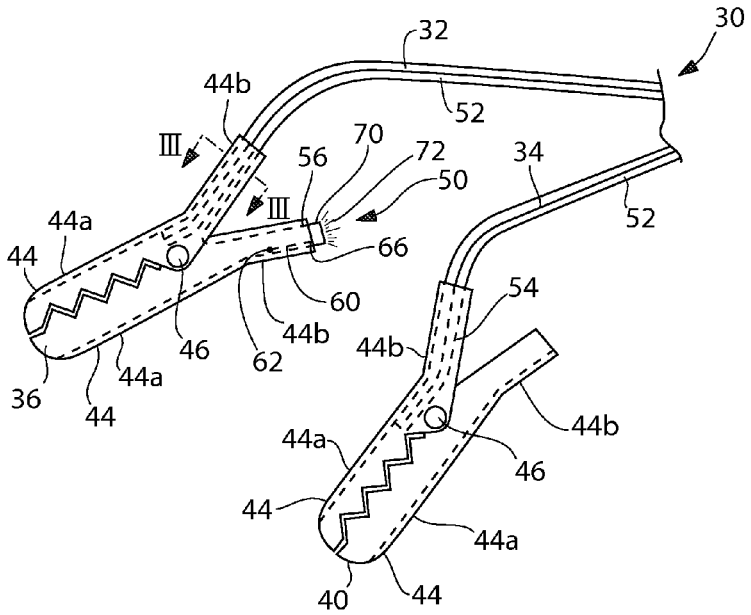
FIG. 2 is a partial enlarged view of the battery jumper cable assembly of FIG. 1 showing the light source on both ends of the red or positive cable.

The best mode for carrying out the invention is presented in terms of its presently preferred embodiment, herein depicted within FIGS. 1 through 2. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The present invention provides a new and unique battery jumper cable assembly that incorporates a light source which will emit light only when the cables are installed correctly. The light source will only work positive to negative. If the positive cable is hooked up incorrectly, the light source will not emit light. Therefore, it is fool-proof method, leaving no opportunity for error or misuse.

Now in reference to FIG. 1, there is illustrated a battery jumper cable assembly, generally designated as 30, for a pair of direct current batteries 10 and 20. In a conventional manner, battery 10 has a positive terminal 12 and a negative terminal 14, while battery 20 has a positive terminal 22 and a negative terminal 24. By way of an example only, battery 10 will be referred to as a source battery having sufficient charge to charge the other discharged or disabled battery 20.

The battery jumper cable assembly 30 includes a pair of electrical cables 32, 34 secured together in a conventional manner, throughout a substantial length thereof. There are also four generally identical battery terminal clamps 36, 38, 40, and 42. Each terminal clamp 36, 38, 40, and 42 is positioned at an end of one of the pair of electrical cables 32, 34. In a conventional manner, two battery terminal clamps, referenced herein with numerals 36 and 38, are identified by a red color for attachment to positive terminals 12, 22 and the other two battery terminal clamps, referenced with numerals 40 and 42, are identified with a black color for attachment to negative terminals 14, 24. Also in a conventional manner, one red and one black battery terminal clamps, 36 and 40 and again 38 and 42 are disposed as a pair in close proximity to and in general alignment with each other at one end of the battery jumper cable assembly 30.

Figure 3:
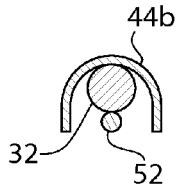
FIG. 3 is a cross-sectional view of the battery jumper cable assembly along lines III-III of FIG. 2.

Now in reference to FIGS. 2-3, and further in a conventional manner, each terminal clamp 36, 38, 40, or 42 includes a pair of elongated clamping elements 44 and a spring 46 joining the pair of clamping elements 44. Each of the pair of clamping elements 44 has each of a clamping jaw portion 44*a* and a handle portion 44*b* arranged so that the spring 46 is disposed mediate thereof. The handle portion 44*b* in the instant invention preferably has a generally U-shape cross-section in a plane generally transverse to a length thereof, whereby each end portion of each cable 32, 34 is received within one handle portion 44*b* of each battery terminal clamp 36, 38, 40, or 42 so that each end of the each cable 32, 34 is secured in electrical connection to a respective jaw portion 44*b*. The other handle portion 44*b* of each battery terminal clamp 36, 38, 40, or 42 is cable-less by being free of any cable received therethrough.

The battery jumper cable assembly 30 further includes at least one and, preferably two polarity indicating apparatuses, generally designated as 50. By way of an example only, the polarity indicating apparatus 50 includes a first electrically conductive wire or conductor 52 having a first end 54 thereof secured in electrical connection directly to a battery terminal clamp 38, 42 designated to engage a negative terminal 14, 24 of one of the pair of batteries 10, 20. Preferably, the first end 54 thereof secured in electrical connection directly to a handle portion 44*a*. Although, it is also contemplated that the first end 54 may be secured in electrical connection to the jaw portion 44*a*. The main length of the first wire 52 is positioned along and secured to the exterior surface of the pair of electrical cables 32, 34 so that a second end 56 of the first wire 52 is positioned within a battery terminal clamp 36, 40 designated to engage the positive terminal 12, 22 of one of the pair of batteries 10, 20. A second electrically conductive wire or conductor 60 is also provided and has a first end 62 thereof secured in electrical connection directly to a cable-less handle portion 44*b* of the battery terminal clamp 36, 40 designated to engage the positive terminal 12, 22 of the one of the pair of batteries 10, 20.

The final essential element of the polarity indicating apparatus is a light source 70. The light source 70 is positioned within or in close proximity to a free end of the cable-less handle portion 44*b* of the battery terminal clamp 36, 38 designated to engage the positive terminal 12, 22 of the one of the pair of batteries 10, 20. The light source 70 is secured in electrical connection directly to opposed ends 56 and 66 of each of the first and second wires, 52 and 60 respectively. The presently preferred light source 70 is a light emitting diode (LED) operable to emit light 72 viewable by a user of the battery jumper cable assembly 30 only when the positive battery terminal clamp 36, 38 is connected to a positive terminal 12, 22 of a battery 10, 20 and when the negative battery terminal clamp 40, 42 is connected to a negative terminal 14, 24 of the battery 10, 20. The LED 70 is mounted so as to pass current flow only from positive battery terminal 12, 22 to a negative battery terminal 14, 24. Furthermore, it is presently preferred that the light source 70 extends, for a small distance, beyond the free end of the cable-less handle portion 44*b* of the battery terminal clamp 36, 38 designated to engage the positive terminal 12, 22 of the respective one of the pair of batteries 10 or 20. It is further presently preferred to provide LED 70 of the type that requires less than about one (1) volt of direct current (VDC) to illuminate. Since, generally, most direct current batteries do not discharge completely and retain some charge, albeit insufficient to power designated devices, it has been found that LED 70 requiring less than about 1 VDC is sufficient to illuminate with most if not all discharged batteries. Since the most common direct current batteries are rated for either 12 VDC or 24 VDC, the LED 70 is selected to cooperate with such batteries. By way of an example only, the LED 70 may be of the LED panel mount type as available from www.redlites.com.

When the polarity indicating apparatus 50 is attached to each end of the battery jumper cable assembly 30, such LED 70 will preferably illuminate only when the black or negative battery terminal clamp 40, having the one end 54 of the first wire 52 secured thereto, is connected to the negative terminal 14 of the battery 10; an opposed black or negative battery terminal clamp 42 is connected to a negative terminal 24 of an opposed battery 20; the red or positive battery terminal clamp 36 having the one end 62 of the second wire 60 secured thereto is connected to the positive terminal 12 of the battery 10; and a remaining red or positive battery terminal clamp 38 is connected to the positive terminal 22 of the opposed battery 20.

The present invention also provides a method for charging a discharged battery 20 from a charged source battery 10 in a manner that insures correct attachment of the battery jumper cable assembly 30. The method, in accordance with a presently preferred embodiment, involves the steps of attaching the polarity indicating apparatus 50 to each end of the battery jumper cable assembly 30. Then, the method involves the step of attaching one end of the battery jumper cable assembly 30 to one battery, preferably being the source battery 10. If the battery jumper cable assembly 30 is attached correctly, LED 70 illuminates (emits light 72). When LED 70 illuminates, the user easily verifies that the battery jumper cable assembly 30 is attached correctly. To further assure safe connection of the battery jumper cable assembly 30, the user can simply and lightly tap the positive and negative terminal clamps 36, 40 against a respective terminal of the battery 10. In this manner, the user will prevent arcing at the connection of the positive and negative terminal clamps 36, 40 with the respective terminals 12, 14 of the battery 10 and will further prevent welding of the positive and negative terminal clamps 36, 40 to the respective terminals 12, 14 of the battery 10. The user then disconnects the red or positive battery terminal clamp 36 that was previously connected but leaves the black or negative battery terminal clamp 40 still connected to the source battery 10. The instant invention also contemplates that the user disconnects and then reconnects the black or negative terminal clamp 40 instead of the red or positive terminal 36. The main reason to disconnect one terminal clamp from the battery terminal of the source battery 10 is to prevent undesirable illumination of the light source 70 mounted on the other end of the battery jumper cable assembly 30.

The next step involves attaching the red and black battery terminal clamps 38, 42 to the other or discharged battery 20. As before, if the battery jumper cable assembly 30 is attached correctly, the LED 70 illuminates and the user easily verifies that this end of the battery jumper cable assembly 30 is attached correctly. The user again can lightly tap the positive and negative terminal clamps 38, 42 against a respective terminal of the battery 20.

This is followed by a step wherein the user reconnects the red or positive battery terminal clamp 36 that had previously been disconnected. Now it is safe to jump start the other or disabled battery. When this battery is sufficiently charged, for example a disabled vehicle will start, the user disconnects the red and then the black battery terminal clamps from this battery 20. Finally, the user disconnects the red and then the black battery terminal clamps from the source battery 10 in a similar manner.

As mentioned previously if the user follows the method as detailed above using the battery jumper cable assembly 30 of the instant invention, such method is perfectly safe for the user and assures that the battery jumper cable assembly 30 is connected correctly.

The afore-described method is afforded by a generally well known condition, wherein the battery 20 is not completely discharged, i.e. battery 20 retains some charge levels sufficient to operate light source 70, even though being insufficient to power devices connected thereto.

It has been found that the afore-described method can be reversed, in a safe manner, with the battery jumper cable assembly 30 being connected first to the discharged battery 20 and then to the source battery 10.

It has also been found that battery jumper cable assembly 30 having polarity indicating apparatus 50 mounted only to one end thereof is also sufficient for safely connecting battery jumper cable assembly 30 to a pair of batteries 10, 20, although resulting in additional steps. For examples, the user can use the end of the battery jumper cable assembly 30, having polarity indicating apparatus 50, to determine proper connection to one of the pair of batteries 10, 20 and then turn or flip the battery jumper cable assembly 30 so as to connect an opposed end thereof to such pair of batteries 10, 20.

The battery jumper cable assembly 30 of the instant invention can be used on cars, motorbikes, boats, lawnmowers or virtually any apparatus that has a direct current battery.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. In combination with a battery jumper cable assembly having a pair of positive battery terminal clamps operatively connected by a first cable and a pair of negative battery terminal clamps operatively connected by a second cable, each of said positive and negative battery terminal clamps having a pair of elongated clamping elements and a spring joining said pair of clamping elements, each of said pair of clamping elements having each of a clamping jaw portion and a handle portion arranged so that said spring is disposed mediate thereof, said handle portion having a generally U-shaped cross-section in a plane generally transverse to a length thereof, at least one polarity indicating apparatus secured to at least one pair of negative and a positive battery terminal clamps, said at least one polarity indicating apparatus comprising:

(a) a first wire having a first end thereof secured in electrical connection directly to a negative battery terminal clamp, said first wire is so secured to said first and second electrical cables along lengths thereof that a second end of said first wire is positioned within a positive battery terminal clamp;

(b) a second wire having a first end thereof secured in electrical connection directly to a cable-less handle portion of said positive battery terminal clamp; and (c) a light source positioned within a free end of said cable-less handle portion of said positive battery terminal clamp, said light source secured in electrical connection directly to opposed ends of each of said first and second wires, said light source operable to emit light viewable by a user of said battery jumper cable assembly only when said positive battery terminal clamp is connected to a positive terminal of a battery and when said negative battery terminal clamp is connected to a negative terminal of a battery.

2. The apparatus, according to claim 1, wherein said apparatus is mounted at each pair of negative and positive battery terminal clamps disposed in close proximity to and in general alignment with each other.

3. The safety jumper cable assembly of claim 1, wherein said light source is a light emitting diode mounted so as to pass current flow only from positive battery terminal to a negative battery terminal.

4. The safety jumper cable assembly of claim 1, wherein said first end of said first wire is secured to a cable-less handle portion.

5. A method of verifying, with a polarity indicating apparatus of claim 1, a correct attachment of a battery jumper cable assembly to a pair of direct current batteries, one of said pair of batteries is a source battery, said method comprising the steps of:

(a) attaching said polarity indicating apparatus of claim 1 to each end of said battery jumper cable assembly;

(b) connecting terminal clamps at one end of said battery jumper cable assembly to respective terminals of said source battery;

(c) verifying with said apparatus, attached in step (a), correct attachment of said jumper cable assembly;

(d) disconnecting positive or negative terminal clamp from said source battery;

(e) connecting terminal clamps of an opposed end of said battery jumper cable assembly to respective terminals of another one of said pair of batteries; and (f) verifying with said apparatus, attached in step (a), correct attachment of said opposed end of said battery jumper cable assembly.

6. The method of claim 5, further comprising the step of reconnecting said positive or negative terminal clamp to said source battery.

7. The method of claim 5, wherein said step (b) or step (e) includes a step of lightly tapping, by user of said battery jumper cable assembly, said terminal clamps against respective battery terminals.

8. The apparatus of claim 1, wherein said light source extends past said free end of said cable-less handle portion of said battery terminal clamp designated to engage the positive terminal of the one of the pair of batteries.

9. A battery jumper cable assembly for a pair of direct current batteries, each having a negative terminal and a positive terminal, said battery jumper cable assembly comprising:

(a) a pair of electrical cables secured together throughout a substantial length thereof;

(b) four battery terminal clamps, each of said four battery terminal clamps positioned at an end of one of said pair of electrical cables, said each of said four battery terminal clamps includes a pair of elongated clamping elements and a spring joining said pair of clamping elements, each of said pair of clamping elements has each of a clamping jaw portion and a handle portion so arranged that said spring is disposed mediate thereof, said handle portion having a generally U-shaped cross-section in a plane generally transverse to a length thereof, whereby each end portion of each cable is received within a handle portion of each battery terminal clamp so that each end of said each cable is secured in electrical connection to a respective jaw portion and whereby a pair of said battery terminal clamps designated to engage a pair of terminals of each of the pair of batteries are disposed in close proximity to and in general alignment with each other;

(c) a first wire having a first end thereof secured in electrical connection directly to a handle portion of a battery terminal clamp designated to engage a negative terminal of one of the pair of batteries, said first wire is so secured to said pair of electrical cables that a second end of said first wire is positioned within a battery terminal clamp designated to engage a positive terminal of the one of the pair of batteries;

(d) a second wire having a first end thereof secured in electrical connection directly to a cable-less handle portion of said battery terminal clamp designated to engage the positive terminal of the one of the pair of batteries; and (e) a light source positioned within a free end of said cable-less handle portion of said battery terminal clamp designated to engage the positive terminal of the one of the pair of batteries, said light source secured in electrical connection directly to opposed seconds ends of each of said first and second wires, said light source operable to emit light viewable by a user of said battery jumper cable assembly only when each battery terminal clamp, having said one end of said first wire secured thereto, is connected to a negative terminal of the one of the pair of batteries and each battery terminal clamp having said one end of said second wire secured thereto is connected to the positive terminal of the one of the pair of batteries.

10. The safety jumper cable assembly of claim 9, wherein said light source is a light emitting diode.

11. The safety jumper cable assembly of claim 10, wherein said light emitting diode extends past said free end of said cable-less handle portion of said battery terminal clamp designated to engage the positive terminal of the one of the pair of batteries.

* * * * *